US006851212B2

(12) United States Patent
Szabo

(10) Patent No.: US 6,851,212 B2
(45) Date of Patent: Feb. 8, 2005

(54) EXTRACTOR ASSEMBLY FOR A SEMI-AUTOMATIC HANDGUN

(76) Inventor: Atilla Szabo, 1 Concorde Place, Toronto, Ontario (CA), PH1 M3C3K6

( * ) Notice: Subject to any disclaimer, the term of this patent is extended or adjusted under 35 U.S.C. 154(b) by 0 days.

(21) Appl. No.: 10/367,682

(22) Filed: Feb. 19, 2003

(65) Prior Publication Data

US 2004/0159032 A1 Aug. 19, 2004

(51) Int. Cl.[7] ..... F41A 15/00
(52) U.S. Cl. ..... 42/25; 42/46; 42/47
(58) Field of Search ..... 42/25, 46, 47

(56) References Cited

U.S. PATENT DOCUMENTS

| | | | | | |
|---|---|---|---|---|---|
| 984,519 | A | * | 2/1911 | Browning | 89/138 |
| 2,894,346 | A | * | 7/1959 | Smith | 42/69.03 |
| 3,090,148 | A | * | 5/1963 | Smith | 42/25 |
| 3,608,223 | A | * | 9/1971 | Dieckermann | 42/25 |
| 3,776,095 | A | * | 12/1973 | Atchisson | 89/128 |
| 3,882,625 | A | * | 5/1975 | Tellie | 42/25 |
| 3,942,277 | A | * | 3/1976 | Atchisson | 42/25 |
| 4,163,334 | A | * | 8/1979 | Tollinger | 42/25 |
| 4,203,348 | A | * | 5/1980 | Sokolovsky | 89/148 |
| 4,416,077 | A | * | 11/1983 | Thompson | 42/25 |
| 4,516,345 | A | * | 5/1985 | Flodman | 42/46 |
| H000087 | H | * | 7/1986 | Reynolds | 42/25 |
| 4,615,132 | A | * | 10/1986 | Smith | 42/25 |
| 4,676,017 | A | * | 6/1987 | Hurlemann et al. | 42/25 |
| 4,862,618 | A | * | 9/1989 | Szabo | 42/7 |
| 4,980,985 | A | * | 1/1991 | Dumortier | 42/46 |
| 5,109,621 | A | * | 5/1992 | Blaser | 42/46 |
| 5,678,340 | A | * | 10/1997 | Moon | 42/25 |
| 5,768,815 | A | * | 6/1998 | Casull | 42/46 |
| 5,794,373 | A | * | 8/1998 | Moon | 42/25 |
| 6,257,116 | B1 | * | 7/2001 | Moczijdlower et al. | 89/155 |
| 6,283,006 | B1 | * | 9/2001 | Szabo et al. | 89/147 |
| 6,393,751 | B1 | * | 5/2002 | Liebenberg | 42/75.01 |
| 6,397,505 | B1 | * | 6/2002 | Stratton et al. | 42/47 |
| 6,405,631 | B1 | * | 6/2002 | Milek | 89/139 |
| 6,415,702 | B1 | * | 7/2002 | Szabo et al. | 89/148 |
| 6,442,882 | B1 | * | 9/2002 | Dionne | 42/77 |

FOREIGN PATENT DOCUMENTS

| | | | |
|---|---|---|---|
| GB | 1238195 | * | 7/1971 |

* cited by examiner

*Primary Examiner*—Michael J. Carone
*Assistant Examiner*—John Richardson
(74) *Attorney, Agent, or Firm*—Finnegan, Henderson, Farabow, Garrett & Dunner, L.L.P.

(57) ABSTRACT

A system and method for extracting a round of ammunition from a semi-automatic handgun having a slide with an opening are provided. An extractor assembly includes a first member configured to be disposed in the opening of the slide such that the slide encloses the first member. A second member has a portion configured to engage a round of ammunition. The second member is configured to pivot relative to the first member. A joint may connect the first member with the second member to allow the second member to pivot relative to the first member to thereby engage the round of ammunition. In addition, a spring may be provided to bias the second member into engagement with the round of ammunition.

48 Claims, 5 Drawing Sheets

EXTRACTOR ASSEMBLY FOR A SEMI-AUTOMATIC HANDGUN

BACKGROUND OF THE INVENTION

The present invention relates to an improvement in a semi-automatic handgun and, more particularly, the present invention relates to an extractor assembly for a semi-automatic handgun.

A semi-automatic handgun is designed to fire a round of ammunition. Each semi-automatic handgun operates in a firing cycle during which the round of ammunition is moved from a storage location, such as a magazine, to a chamber in the handgun. The round of ammunition is then fired and the spent ammunition casing, or shell, is extracted from the chamber and ejected from the handgun so that a new round may be loaded for firing.

Typically, each semi-automatic handgun includes a slide that governs the movement of the ammunition round during the firing cycle. The slide moves between a rearward position and a forward position on the handgun. As the slide moves from the rearward position to the forward position, the slide extracts a round of ammunition from the storage location and moves the round into the chamber and into position for firing.

Each round of ammunition typically includes a casing, an explosive charge, and a projectile. The casing houses the explosive charge and the projectile. The round is fired when a mechanical force, such as from a firing pin or a striker, is delivered to the casing. The force ignites the explosive charge, which then acts on the projectile to propel the projectile down the barrel.

To remove a spent casing from the chamber and eject the spent casing from the handgun, each handgun typically includes an extractor and an ejector. The extractor may be mounted in the slide and adapted to engage a rim, or lip, on the casing of the ammunition round as the ammunition round moved from the storage location to the chamber. The extractor remains in contact with the casing rim as the ammunition round is positioned in the chamber and the round is fired.

After the round is discharged, the force of the discharge causes the slide and extractor to move towards the rearward position. As the slide retracts, the extractor remains engaged with the rim of the casing so that the casing moves with the slide. Eventually, the spent casing comes into contact with the ejector, which may be mounted on the frame. The resulting force on the casing causes the casing to disengage from the extractor and exit the handgun through an ejection port in the slide. The slide continues moving rearward until it reaches its rearward position. The slide then returns to its forward position, loading another round of ammunition into the chamber in the process.

A jam or misfeed situation may occur when the handgun experiences a problem in the firing cycle. This type of situation may arise when, for example, the round of ammunition is not properly fed into the chamber or when the spent casing is not properly extracted from the chamber and ejected from the handgun. In either of these circumstances, the firing cycle is interrupted and the user must manually resolve the problem, either by extracting the spent casing or by helping to guide the round of ammunition into the chamber.

In some semi-automatic handguns, a known cause of a jam is a dysfunctional extractor. Typically, the extractor is made of a resilient, or spring-like, material and is placed in an extractor opening that is drilled in the slide. The extractor opening extends from the rear end of the slide to the breech face. The extractor opening is designed to place the extractor into a position where the extractor will engage the rim of the ammunition round as the round is moved from the storage location to the chamber. The elasticity of the extractor biases the extractor towards the ammunition round to maintain the engagement of the extractor with the round and ensure that the round is properly extracted upon discharge. However, if the handgun has experienced heavy use, or if the extractor opening is made slightly out of tolerance, the extractor may not always maintain engagement with the rim of the ammunition round. Either circumstance may result in the ammunition round not being removed from the chamber or in the round not being ejected from the slide.

In light of the foregoing there is a need for an improved extractor assembly for a semi-automatic handgun that will reduce the likelihood of a jam or misfeed situation during the firing cycle of the handgun.

SUMMARY OF THE INVENTION

Accordingly, the present invention is directed to an improved semi-automatic handgun that obviates one or more of the limitations and disadvantages of the prior art semi-automatic handguns. The advantages and purposes of the invention will be set forth in part in the description which follows, and in part will be obvious from the description, or may be learned by practice of the invention. The advantages and purposes of the invention will be realized and attained by the elements and combinations particularly pointed out in the appended claims.

To attain the advantages and in accordance with the purposes of the invention, as embodied and broadly described herein, the invention is directed to an extractor assembly for a semi-automatic handgun having a slide with an opening. The extractor assembly includes a first member configured to be disposed in the opening of the slide. The slide encloses the first member. A second member has a portion configured to engage a round of ammunition. A joint connects the first member with the second member and is configured to allow the second member to pivot relative to the first member to thereby engage the round of ammunition.

According to another aspect, the invention is directed to a method of assembling an extractor assembly for a semi-automatic handgun having a slide. A first member is configured to be disposed in an opening of a slide such that the slide encloses the first member. A second member having a portion configured to engage a round of ammunition is operatively engaged with the first member such that the second member may pivot relative to the first member. The first and second members are disposed in the opening of the slide.

In another aspect, the invention is directed to a method of extracting a round of ammunition from a semi-automatic handgun. A round of ammunition is loaded into a chamber of the semi-automatic handgun. An extractor assembly disposed in an opening in a slide and substantially enclosed by the slide engages the round of ammunition. The extractor assembly includes a first member and a second member that is configured to pivot relative to the first member to allow a portion of the second member to engage the round of ammunition. The second member is biased with a spring such that the portion engages the round of ammunition.

In still another aspect, the invention is directed to an extractor assembly for a semi-automatic handgun having a slide with an opening. A first member is configured to be disposed in the opening of the slide such that the slide encloses the first member. A second member having a portion configured to engage a round of ammunition is operatively engaged with the first member to allow the first member to pivot relative to the first member. A spring is configured to act on the second member to pivot the second member into engagement with the round of ammunition.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate one embodiment of the invention and together with the description, serve to explain the principles of the invention. In the drawings.

DETAILED DESCRIPTION

Reference will now be made in detail to the presently preferred embodiment of the invention, an example of which is illustrated in the accompanying drawings. Wherever possible, the same reference numbers will be used throughout the drawings to refer to the same or like parts.

In accordance with the present invention, a semi-automatic handgun is provided. In the accompanying drawings and by way of example, a 1911A1 model handgun is illustrated and described. It should be noted, however, that the present invention may be applied to other models of semi-automatic handguns. The 1911A1 model handgun is disclosed in U.S. Pat. No. 984,519, which is hereby incorporated by reference. U.S. Pat. No. 984,519 discloses the overall structure and operation of the 1911A1 model handgun and its disclosure of the basic structural components and operation will not be repeated. The present invention may also be applied to handguns that include variations on the conventional 1911A1 model design, such as, for example, those handguns described in U.S. Pat. Nos. 6,283,006 and 6,415,702, which are hereby incorporated by reference. An exemplary 1911A1 model handgun is shown in FIG. 1 and is designated generally by reference number 20.

Figure 1:
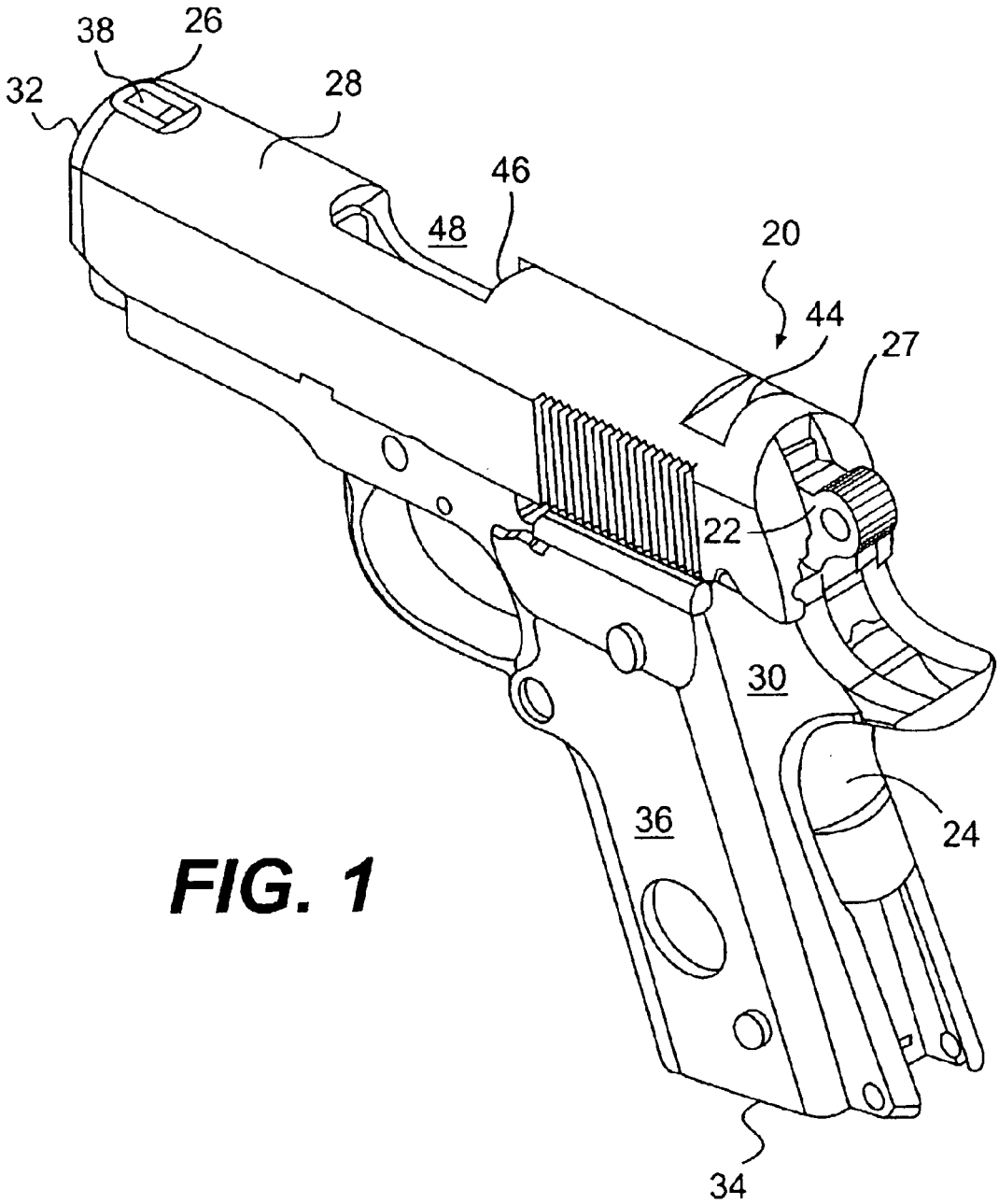
FIG. 1 is a pictorial view of a semi-automatic handgun according to the present invention.

As best illustrated in FIG. 1, semi-automatic handgun 20 includes a frame 30. Frame 30 includes a handle portion 36 that has an opening 34 configured to receive a magazine. In an embodiment of the present invention, the magazine is a high-capacity magazine. The structure and operation of the frame and high-capacity magazine are disclosed in U.S. Pat. No. 4,862,618, which is hereby incorporated by reference. While the present embodiment utilizes the high capacity magazine, it is contemplated that a standard magazine, such as disclosed in U.S. Pat. No. 984,519, could also be used.

Figure 2:
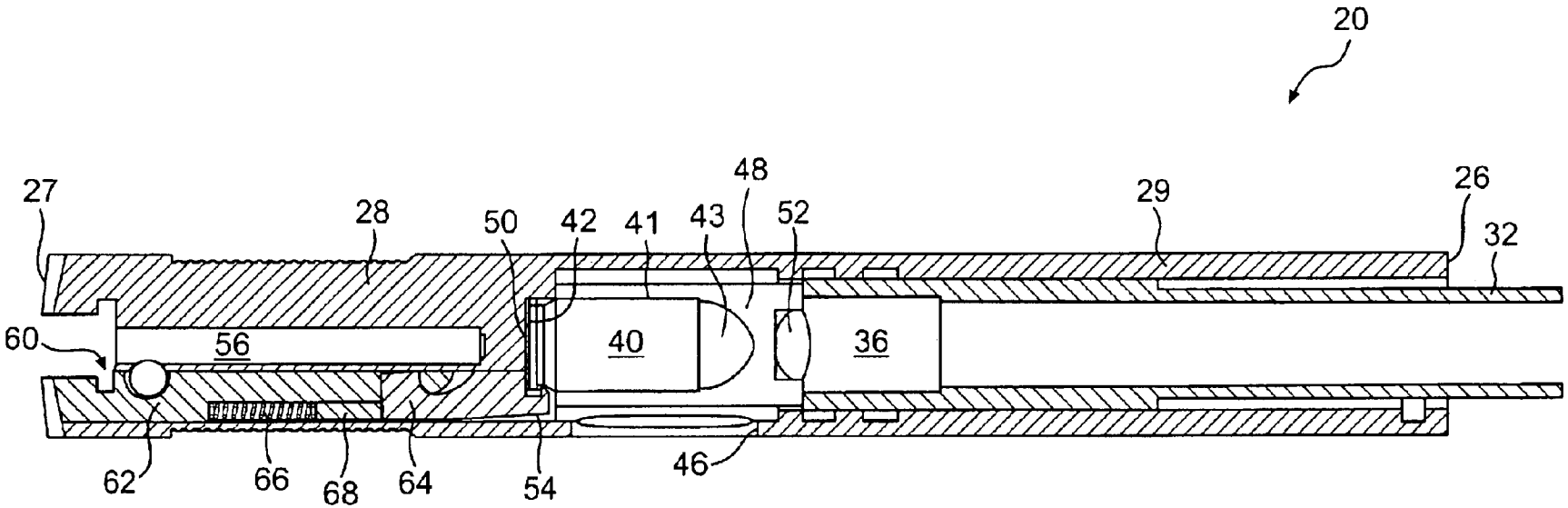
FIG. 2 is a top view of a slide and an extractor assembly in accordance with the present invention, illustrating the slide in a rearward position.

As illustrated in FIG. 2, handgun 20 also includes a barrel 32. Barrel 32 includes a chamber 36. Chamber 36 is configured to receive a round of ammunition 40 from the magazine. Ammunition round 40 may include a casing 41 having a rim 42. Ammunition round 40 may also include an explosive charge disposed in casing 41 and a projectile 43.

In a 1911A1 model handgun, barrel 32 is connected to frame 30 through a pivoting link. Barrel 32 includes a projection (not shown) having an opening. A linking member (not shown) engages the opening and establishes the pivoting link with frame 30.

Barrel 32 also includes a feed ramp 52. Feed ramp 52 is positioned between the magazine and chamber 36. Projectile 43 of ammunition round 40 may engage feed ramp 52 as ammunition round 40 is moved from the magazine to chamber 36. In this manner, feed ramp 52 may guide ammunition round 40 into chamber 36.

As shown in FIG. 1, semi-automatic handgun 20 also includes a hammer 22. Hammer 22 is pivotally mounted with respect to frame 30. Hammer 22 is adapted to rotate between a rearward, or cocked position, and a forward, or rest position. A sear (not shown) may be mounted in frame 30 and configured to hold hammer 22 in the cocked position.

Semi-automatic handgun 20 may also include a mainspring (not shown) that is operatively connected to hammer 22. A rotation of hammer 22 from the forward position towards the rearward position and into engagement with the sear may act to compress the mainspring. When the sear is disengaged to release hammer 22, the mainspring acts on hammer 22 to rotate hammer 22 towards the forward position.

In accordance with the present invention, the semi-automatic handgun includes a slide that is mounted on the frame for reciprocating movement between a forward position and a rearward position. The slide includes a breech configured to receive a round of ammunition. The slide also includes an opening configured to receive an extractor assembly.

As illustrated in FIG. 2, a slide 28 includes a front end 26 and a rear end 27. Front end 26 includes a barrel opening 29 that is configured to receive barrel 32. As shown in FIG. 1, front end 26 of slide 28 may also include a front connector 38. Any of a variety of front sights may be attached to connector 38. Similarly, rear end 27 of slide 28 includes a rear connector 44, to which a rear sight may be attached.

As shown in FIG. 1, slide 28 is mounted on frame 30. Slide 28 may include a pair of grooves (not shown) that are adapted to engage a pair of corresponding rails (not shown) on the top of frame 30. The engagement of the grooves of slide 28 and the rails on frame 30 allow slide 28 to slide between a forward position (as illustrated in FIG. 1) and a rearward position (as illustrated in FIG. 2).

Slide 28 also includes a breech 48. As illustrated in FIG. 2, breech 48 includes a breech face 50 and an ejection port 46. Breech face 50 is adapted to engage an ammunition round 40 held by magazine as slide 28 moves from the rearward position to the forward position. As slide 28 moves to the forward position, breech face 50 moves ammunition round 40 up feed ramp 52 and into chamber 36. Ejection port 46 may be sized to allow a spent casing to be ejected therethrough.

Slide 28 further includes a first opening 54 and a second opening 56. First opening 54 extends from the rear end 27 face of slide 30 to breech face 50. Second opening 56 also extends from rear end 27 of slide 28 to breech face 50. The size of second opening 56 may become narrower as second opening 56 approaches breech face 50.

Second opening 56 is configured to receive a firing pin (not shown) and to position the firing pin between hammer 22 and ammunition round 40 housed in chamber 36. When hammer 22 is released from the sear, the mainspring acts on hammer 22 to rotate hammer 22 into engagement with the firing pin. The force generated by the mainspring is transferred through the firing pin to ammunition round 40 to thereby discharge ammunition round 40. Second opening 56 may be adapted to guide the firing pin and ensure that the firing pin contacts ammunition round 40 when struck by hammer 22.

In accordance with the present invention, the semi-automatic handgun also includes an extractor assembly. The extractor assembly includes a first member and a second member. The first member is configured to be disposed in the opening of the slide. The second member includes a portion, such as, for example, a hook, configured to engage a round of ammunition and is operatively engaged with the first member to allow the second member to pivot relative to the first member. The portion configured to engage the ammunition round may take on alternative shapes. The extractor assembly may also include a spring that acts on the second member to pivot the second member into engagement with the rim of the round of ammunition.

Figure 3:
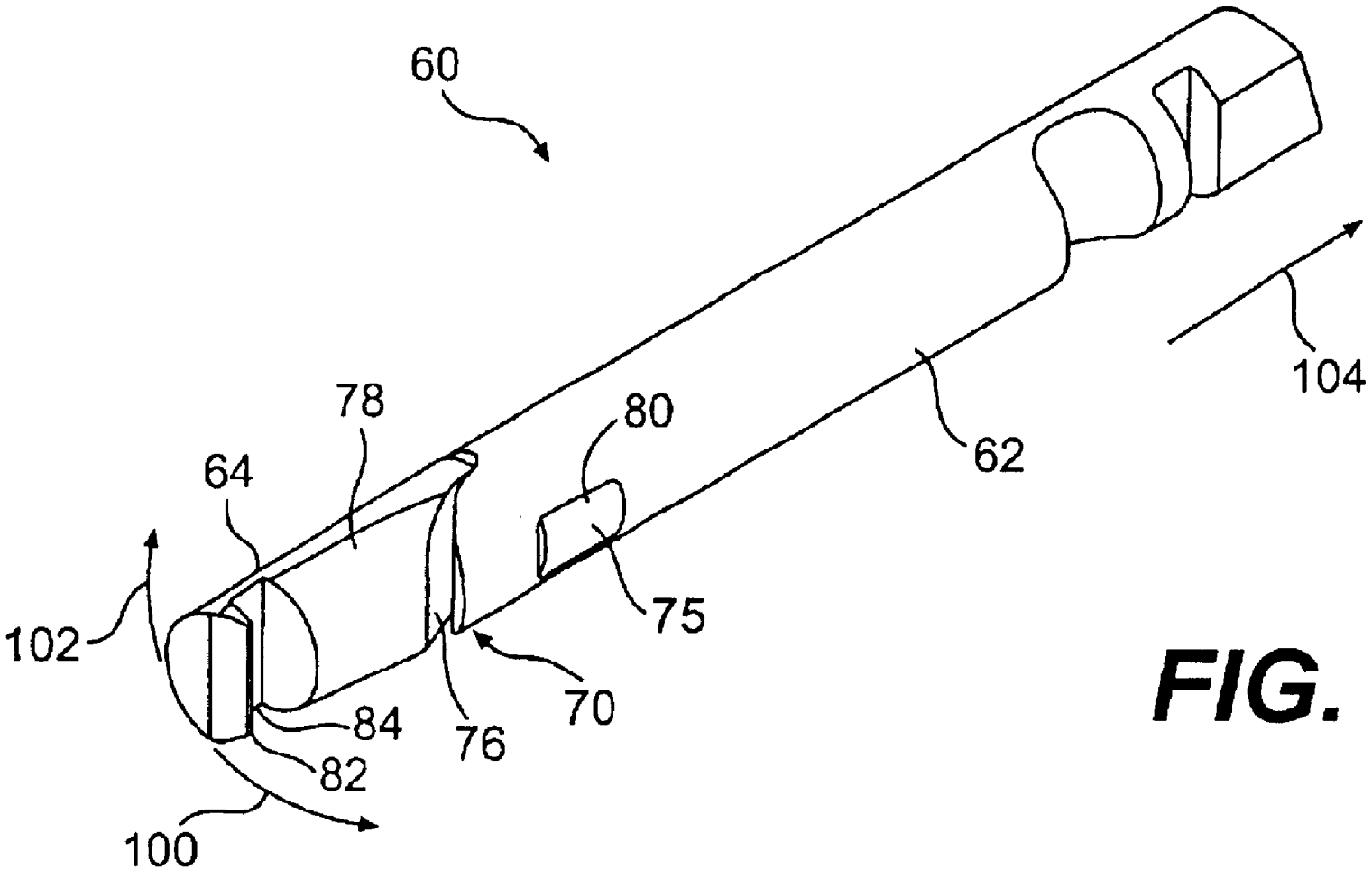
FIG. 3 is a pictorial view of an extractor assembly for a semi-automatic handgun according to the present invention.

An exemplary embodiment of an extractor assembly 60 is illustrated in FIG. 3. As shown, extractor assembly 60 includes a first member 62 and a second member 64. Second member 64 may include a hook 82 and a groove 84. Hook 82 and groove 84 may be adapted to engage a portion, such as for example, a rim 42, of ammunition round 40. One skilled in the art will recognize that the configuration of hook 82 and groove 84 may be modified to allow extractor assembly 60 to engage any particular type of ammunition. In addition, the configuration of hook 82 and groove 84 may be adapted to engage different portions of the round of ammunition.

A joint 70 connects first member 62 and second member 64. Joint 70 allows second member 64 to pivot relative to first member 62. In the exemplary embodiment illustrated in FIG. 4, joint 70 includes a projection 72 on second member 64 that is engageable with an opening 80 in first member 62. Preferably, projection 72 and opening 80 are adapted to allow projection 72 to move within opening 80 to thereby allow second member 64 to pivot relative to first member 62. One skilled in the art will recognize that joint 70 may have any configuration that will allow second member 64 to pivot relative to first member 62, such as, for example, a pin joint, a ball joint, or a hinge.

Figure 5:
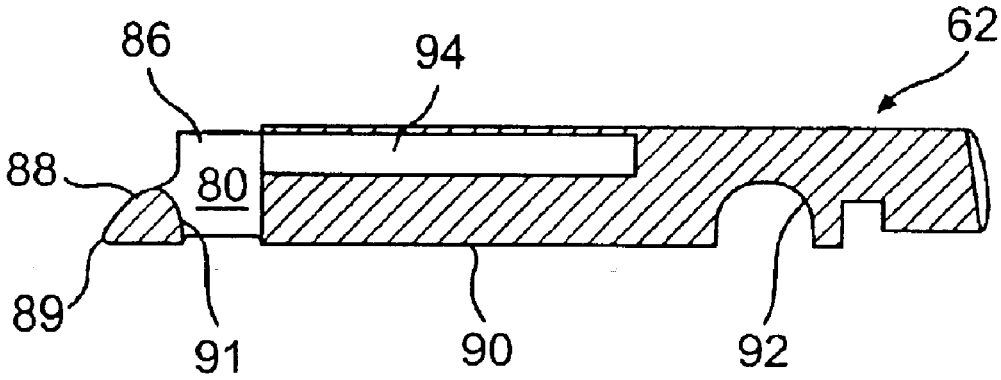
FIG. 5 is a cross sectional view of a first member of an extractor assembly in accordance with an exemplary embodiment of the present invention.

As shown in FIG. 5, opening 80 in first member 62 is defined by a curved surface 88 and a straight surface 91. Curved surface 88 extends from a front edge 89 of the first member to straight surface 91. Straight surface 91 extends substantially perpendicularly to outer surface 90 of first member 62.

Figure 4:
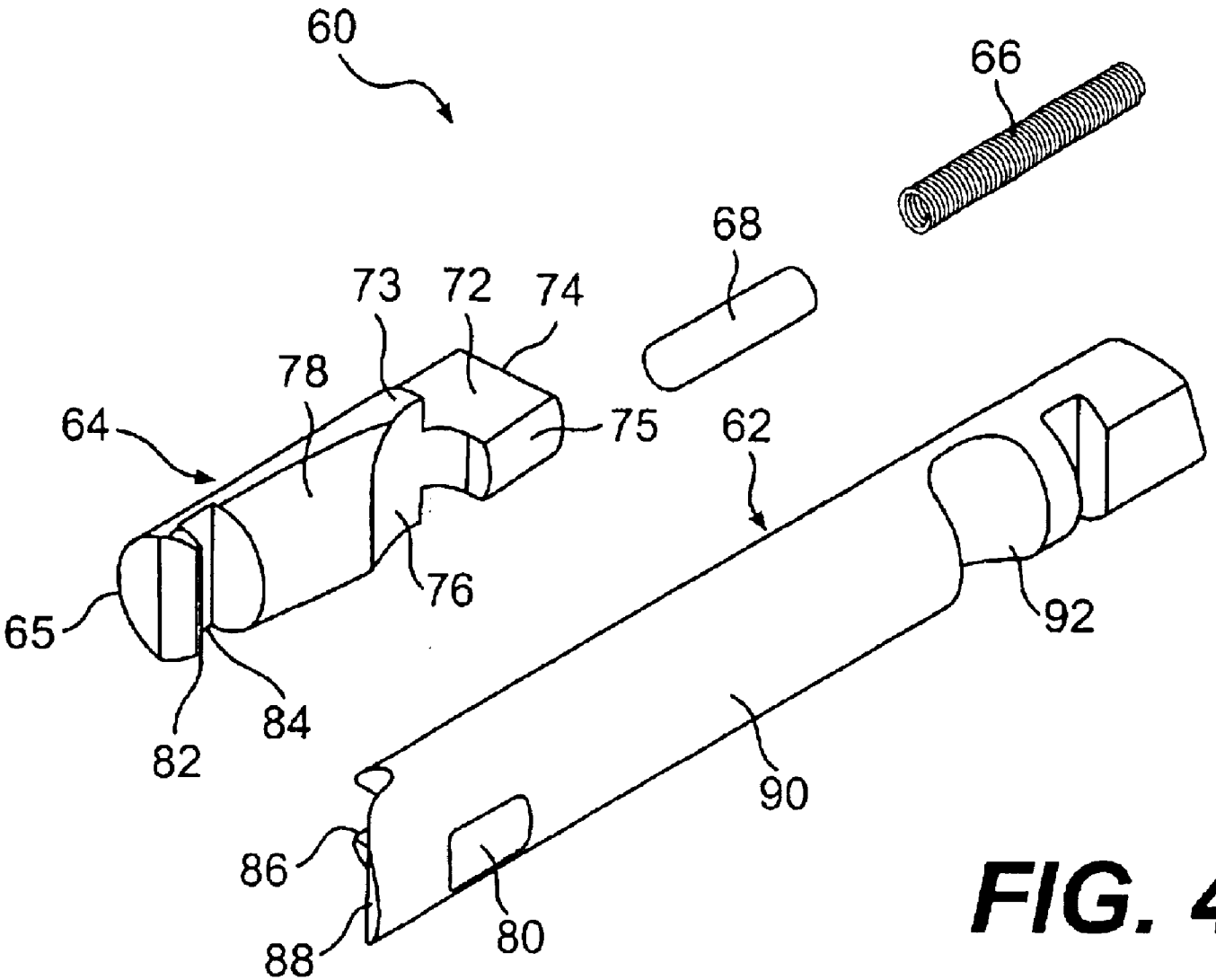
FIG. 4 is an exploded view of the extractor assembly of FIG. 3.

As shown in FIG. 4, second member 64 also includes a curved surface 76 and a straight surface 77. Curved surface 76 is configured to correspond to curved surface 88 of first member 62. The radius of curvature of curved surface may increase as curved surface 76 extends away from straight surface 77.

Projection 72 of first member 62 may be disposed in opening 80 of first member 62 to form joint 70. In this position, curved surface 88 of first member 62 aligns with curved surface 76 of second member 64 and straight surface 91 of first member 62 aligns with straight surface 77 of second member 64. Curved surfaces 76 and 88 may be configured to guide second member 64 through a pivoting movement relative to first member 62 (as shown by arrows 100 and 102 of FIG. 3). Straight surfaces 77 and 91 engage and provide a contact surface when a force is exerted on extractor assembly 60 in the direction of arrow 104 (referring to FIG. 3).

As shown in FIGS. 4 and 5, first member 62 may also include a notch 86 disposed adjacent opening 80. Preferably, notch 86 has a width substantially equivalent to the width of projection 72. When projection 72 is engaged with notch 86 and opening 80, the close tolerance between notch 86 and projection 72 prevents an undesired motion, such as, for example, a twisting movement, of second member 64 relative to first member.

First member 62 also includes an outer surface 90. Outer surface 90 may be rounded and configured to fit within opening 54 of slide 28. First member 62 may also include any other features necessary for the operation of the particular handgun. For example, first member 62 may include a groove 92 that is configured to receive a firing pin plunger.

Second member 64 also includes an outer surface 78. Outer surface 78 of second member 64 may also be rounded and adapted to fit within opening 54 of slide 28. A first end 65 of second member 64, i.e. the end adjacent hook 82 and groove 84, may be smaller than a second end 73 of second member 64, i.e. the end adjacent projection 72. The smaller size of first end 65 provides a clearance with opening 54 of slide 28 that allows second member 64 to pivot relative to first member 62 within opening 54 of slide 28.

Figure 6:
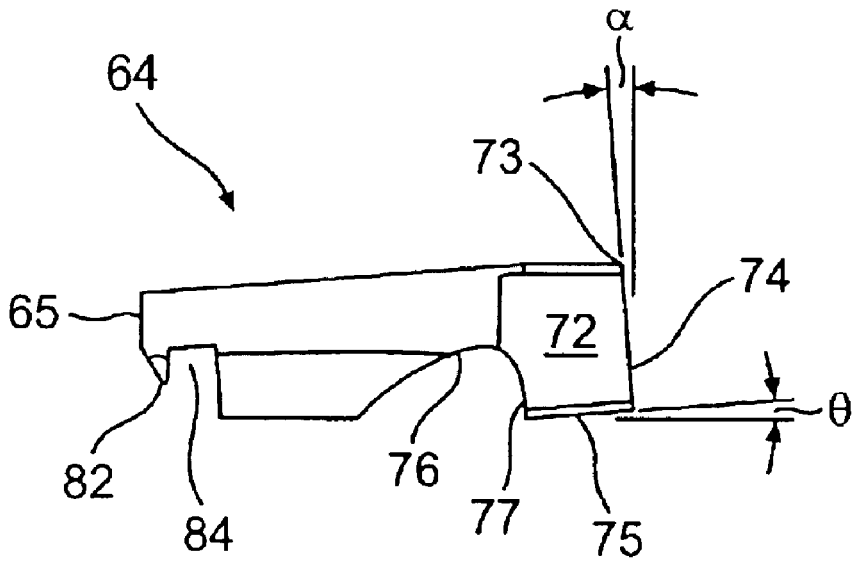
FIG. 6 is a cross sectional view of a second member of an extractor assembly in accordance with an exemplary embodiment of the present invention.

An end 75 of projection 72 may also be rounded. End 75 of projection 72 may be configured such that when projection 72 is disposed within opening 80 of first member 62, end 75 substantially conforms to the shape of outer surface 90 of first member 62. As shown in FIG. 6, end 75 may also include an angle, e, that slopes away from opening 80 between curved surface 76 and a rear face 74. This angle provides additional clearance between projection 72 and opening 54 in slide 28 to allow second member 64 to pivot relative to first member 62.

As further shown in FIG. 6, rear face 74 may also be disposed at an angle, $\alpha$. Angle, $\alpha$, may provide additional clearance between projection 72 and first member 62. This additional clearance allows second member 64 to pivot relative to first member 62.

As shown in FIG. 5, first member 62 also includes a bore 94 that extends from notch 86. Bore 94 is adapted to receive a spring 66 and a pin 68 (referring to FIG. 4). Spring 66 may be disposed in bore 94 to act on pin 68 to bias pin 68 out of bore 94 and into engagement with rear face 74 of second member 64.

As shown in FIG. 1, frame 30 may also mount safety devices for the handgun 20. These safety devices may include a manual, or "thumb" safety and a grip safety 24. The manual safety may be manually moved between a safe position where the manual safety engages a notch in slide 28. In the safe position, the manual safety prevents slide 28 from moving from the forward position to the rearward position.

As also shown in FIG. 1, grip safety 24 is disposed in handle portion 36 of frame 30. A spring (not shown) biases grip safety 24 into a safe position where grip safety 24 engages a notch in hammer 22. When grip safety 26 is engaged with the notch in hammer 22, hammer 22 is prevented from moving relative to frame 30. Grip safety 24 is typically disengaged from hammer 22 when a user grips the handgun 20 in a standard firing position. The user's grip overcomes the spring bias acting on grip safety 24, and the grip safety pivots out of contact with hammer 22 to thereby allow hammer 22 to pivot relative to frame 30.

The operation of the aforementioned device will now be described with reference to the attached drawings. A user may insert a magazine containing a number of rounds of ammunition into frame 30. The user may then retract slide 28 to its rearward position and release slide 28. As slide 28 returns to its forward position, breech face 50 engages ammunition round 40 in the magazine and moves the ammunition round 40 into breech 48 and towards chamber 36.

As shown in FIG. 2, when slide 28 moves ammunition round 40 from the magazine into breech 48, hook 82 and groove 84 of extractor assembly 60 engage ammunition round 40. Spring 66 acts through pin 68 to pivot second member 64 towards ammunition round 40 (in the direction of arrow 100 of FIG. 3). Hook 82 may be adapted to engage the neck of ammunition round 40.

The force of spring 66 acting through hook 82 may facilitate the movement of ammunition round 40 along feed ramp 52 and into chamber 36. The engagement of hook 82 with the neck of ammunition round 40 may create less friction than a direct engagement of groove 84 with the outer edge of rim 42. In addition, the force of spring 66 may prevent an undesired lateral motion of ammunition round 40. In this manner the extractor assembly may act to positively control the feeding of a round of ammunition to chamber 36, thereby reducing the likelihood of a misfeed situation.

The force of spring 66 and the pivoting motion of second member 64 allow extractor assembly 64 to fully engage rim 42 of ammunition round 40 even when the dimensions of successive ammunition rounds include variations in size or rim dimensions. The force of spring 66 continues to act on second member 64 to ensure hook 82 and groove 84 remain engaged with rim 42 of ammunition round 40 during the firing cycle of the handgun 20. Thus, extractor assembly 60 relies on the force of spring 66, instead of an inherent material elasticity in the extractor material, to ensure consistent extraction of spent casings.

In certain circumstances, an ammunition round 40 may be "dropped" or loaded into chamber 36 before slide 28 moves to the forward position. In this situation, as slide 28 moves forward, rim 42 of ammunition round 40 will engage second member 64 and cause second member 64 to pivot outwardly (i.e. in the direction of arrow 102 of FIG. 3) to move around rim 42. The force of spring 66 will then act on second member 64 to pivot second member 64 such that hook 82 and groove 84 engage rim 42 of ammunition round 40. Thus, extractor assembly 60 may engage a pre-loaded ammunition round, without unduly stressing and/or weakening the extractor.

After ammunition round 40 is positioned in chamber 36, the user may discharge the handgun by pulling the trigger of handgun 20. The trigger pull disengages the sear from hammer 22, thereby allowing the mainspring to rotate hammer 22 into contact with the firing pin. The firing pin transmits the force generated by the released mainspring to ammunition round 40, thereby discharging ammunition round 40.

In response to the discharge of ammunition round 40, slide 28 recoils to its rearward position. As slide 28 recoils, extractor assembly 60 pulls the spent casing rearwardly from chamber 36. Eventually, the casing will engage an ejector that is positioned on the opposite side of slide 28 from extractor assembly 60. The contact between the spent casing and the ejector causes the spent casing to pivot, or spin, relative to extractor assembly 60. Second member 64 may pivot outwardly (i.e. in the direction of arrow 102 of FIG. 3) to allow rim 42 of the spent casing 41 to disengage from hook 82 and notch 84 of extractor assembly 60. The spent casing then ejects from handgun 20 through ejection port 46.

After the spent casing has ejected from slide 28, slide 28 continues to recoil to its rearward position. Slide 28 then returns to its forward position and moves another round of ammunition into chamber 36. The firing process may then be repeated.

It will be apparent to those skilled in the art that various modifications and variations can be made in the method of manufacture of the present invention and in construction of this extractor assembly without departing from the scope or spirit of the invention. Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed:

1. An extractor assembly for a semi-automatic handgun having a slide with an opening, comprising:

a first member configured to be disposed in the opening of the slide, the slide enclosing the first member;

a second member having a portion configured to engage a round of ammunition; and a joint connecting the first member with the second member and configured to allow the second member to pivot relative to the first member to thereby engage the round of ammunition.

2. The extractor assembly of claim 1, further including a spring configured to act on the second member to pivot the second member into engagement with a rim of the round of ammunition.

3. The extractor assembly of claim 2, wherein the first member includes a bore configured to receive the spring.

4. The extractor assembly of claim 3, further including a pin disposed between the spring and the second member.

5. The extractor assembly of claim 1, wherein the second member includes a groove disposed adjacent the portion of the second member configured to engage the round of ammunition.

6. The extractor assembly of claim 1, wherein the first member defines an opening having a surface and the second member includes a projection configured for disposal in the opening and further configured to engage at least a portion of the surface of the opening.

7. The extractor assembly of claim 6, wherein the first member includes a notch adjacent the opening and the projection of the second member is configured to be disposed in the notch.

8. The extractor assembly of claim 6, wherein the first member includes a curved surface adjacent the opening and the second member includes a curved surface adjacent the projection, the curved surfaces of the first and second members adapted for engagement when the projection of the first member is disposed in the opening of the second member.

9. The extractor assembly of claim 1, wherein the second member includes a rear face adapted for alignment adjacent to an end of the first member, the rear face disposed at an angle relative to the end of the first member.

10. The extractor assembly of claim 1, wherein the size of second member at an end adjacent the joint is greater than the size of the second member at an end adjacent the portion of the second member configured to engage the round of ammunition.

11. The extractor assembly of claim 1, wherein the portion of the second member configured to engage the round of ammunition is a hook.

12. A semi-automatic handgun, comprising:

a frame;

a slide disposed on the frame for movement between a forward position and a rearward position, the slide including an opening; and an extractor assembly adapted to be disposed in the opening of the slide, the extractor assembly including:

a first member configured to be disposed in the opening of the slide, the slide enclosing the first member;

a second member having a portion configured to engage a round of ammunition; and a joint connecting the first member with the second member and configured to allow the second member to pivot relative to the first member to thereby engage the round of ammunition.

13. The handgun of claim 12, wherein the extractor assembly further includes a spring configured to act on the second member to pivot the second member into engagement with a rim of the round of ammunition.

14. The handgun of claim 13, wherein the first member includes a bore configured to receive the spring and the extractor assembly further includes a pin disposed between the spring and the second member.

15. The handgun of claim 12, wherein the second member includes a groove disposed adjacent the portion of the second member configured to engage the round of ammunition.

16. The handgun of claim 12, wherein the first member defines an opening having a surface and the second member includes a projection configured for disposal in the opening and further configured to engage at least a portion of the surface of the opening.

17. The handgun of claim 16, wherein the first member includes a notch adjacent the opening and the projection of the second member is configured to be disposed in the notch.

18. The handgun of claim 17, wherein the first member includes a curved surface adjacent the opening and the second member includes a curved surface adjacent the projection, the curved surfaces of the first and second members adapted for engagement when the projection of the first member is disposed in the opening of the second member.

19. The handgun of claim 12, wherein the second member includes a rear face adapted for alignment adjacent to an end of the first member, the rear face disposed at an angle relative to the end of the first member.

20. The handgun of claim 12, wherein the size of second member at an end adjacent the joint is greater than the size of the second member at an end adjacent the portion of the second member configured to engage the round of ammunition.

21. A method of assembling an extractor assembly for a semi-automatic handgun having a slide, comprising:

providing a first member configured to be disposed in an opening of a slide such that the slide encloses the first member;

linking a second member having a portion configured to engage a round of ammunition with the first member such that the second member may pivot relative to the first member; and disposing the first and second members in the opening of the slide.

22. The method of claim 21, further including operatively engaging the slide with a frame of the handgun to allow the slide to move between a forward position and rearward position.

23. The method of claim 21, further including disposing a joint between the first and second members.

24. The method of claim 21, further including disposing a spring and a pin in a bore in the first member, the spring acting to bias the pin into engagement with the second member to pivot the second member relative to the first member.

25. A method of extracting a round of ammunition from a semi-automatic handgun, comprising:

loading a round of ammunition into a chamber of the semi-automatic handgun;

engaging the round of ammunition with an extractor assembly disposed in an opening in a slide such that the slide substantially encloses the extractor assembly, the extractor assembly including a first member and a second member in linked engagement with the first member and configured to pivot relative to the first member to allow a portion of the second member to engage the round of ammunition; and biasing the second member with a spring such that the portion engages the round of ammunition.

26. The method of claim 25, wherein the extractor assembly engages the round of ammunition as the round of ammunition is loaded into the chamber of the semi-automatic handgun.

27. The method of claim 25, wherein the spring acts on the second member through a pin and the spring and pin are disposed in a bore in the first member.

28. The method of claim 25, further including pivoting the second member relative to the first member to compress the spring and allow the portion of the second member to engage a round of ammunition loaded into the chamber of the semi-automatic handgun as the slide moves towards a forward position.

29. An extractor-assembly for a semi-automatic handgun having a slide with an opening, comprising:

a first member configured to be disposed in the opening of the slide such that the slide encloses the first member;

a second member having a portion configured to engage a round of ammunition, the second member in linked engagement with the first member to allow the second member to pivot relative to the first member; and a spring configured to act on the second member to pivot the second member into engagement with the round of ammunition.

30. The extractor assembly of claim 29, further including a joint connecting the first member with the second member and configured to allow the second member to pivot relative to the first member.

31. The extractor assembly of claim 29, wherein the first member includes a bore configured to receive the spring.

32. The extractor assembly of claim 29, further including a pin disposed between the spring and the second member.

33. The extractor assembly of claim 29, wherein the second member includes a groove disposed adjacent the portion of the second member configured to engage the round of ammunition.

34. The extractor assembly of claim 29, wherein the first member defines an opening having a surface and the second member includes a projection configured for disposal in the opening and further configured to engage at least a portion of the surface of the opening.

35. The extractor assembly of claim 34, wherein the first member includes a notch adjacent the opening and the projection of the second member is configured to be disposed in the notch.

36. The extractor assembly of claim 34, wherein the first member includes a curved surface adjacent the opening and the second member includes a curved surface adjacent the projection, the curved surfaces of the first and second members adapted for engagement when the projection of the first member is disposed in the opening of the second member.

37. The extractor assembly of claim 29, wherein the second member includes a rear face adapted for alignment adjacent to an end of the first member, the rear face disposed at an angle relative to the end of the first member.

38. The extractor assembly of claim 29, wherein the size of second member at an end adjacent the joint is greater than the size of the second member at an end adjacent the portion of the second member configured to engage the round of ammunition.

39. A semi-automatic handgun, comprising:

a frame;

a slide disposed on the frame for movement between a forward position and a rearward position, the slide including an opening; and an extractor assembly adapted to be disposed in the opening of the slide, the extractor assembly including:

a first member configured to be disposed in the opening of the slide, the slide enclosing the first member;

a second member having a portion configured to engage a round of ammunition, the second member in linked engagement with the first member to allow the second member to pivot relative to the first member; and a spring configured to act on the second member to pivot the second member into engagement with the round of ammunition.

40. The handgun of claim 39, further including a joint connecting the first member with the second member and configured to allow the second member to pivot relative to the first member.

41. The handgun of claim 39, wherein the extractor assembly further includes a spring configured to act on the second member to pivot the second member into engagement with the round of ammunition.

42. The handgun of claim 39, wherein the first member includes a bore configured to receive the spring and the extractor assembly further includes a pin disposed between the spring and the second member.

43. The handgun of claim 39, wherein the second member includes a groove disposed adjacent the portion of the second member configured to engage the round of ammunition.

44. The handgun of claim 39, wherein the first member defines an opening having a surface and the second member includes a projection configured for disposal in the opening and further configured to engage at least a portion of the surface of the opening.

45. The handgun of claim 44, wherein the first member includes a notch adjacent the opening and the projection of the second member is configured to be disposed in the notch.

46. The handgun of claim 44, wherein the first member includes a curved surface adjacent the opening and the second member includes a curved surface adjacent the projection, the curved surfaces of the first and second members adapted for engagement when the projection of the first member is disposed in the opening of the second member.

47. The handgun of claim 39, wherein the second member includes a rear face adapted for alignment adjacent to an end of the first member, the rear face disposed at an angle relative to the end of the first member.

48. The handgun of claim 39, wherein the size of second member at an end adjacent the joint is greater than the size of the second member at an end adjacent the portion of the second member configured to engage the round of ammunition.

* * * * *